United States Patent [19]

Heard

[11] 4,125,240

[45] Nov. 14, 1978

[54] SECURING DEVICE

[76] Inventor: Robert A. H. Heard, Church Farm, 63 Church Lane, Backwell, Bristol, England, BS19 3JJ

[21] Appl. No.: 777,855

[22] Filed: Mar. 15, 1977

[30] Foreign Application Priority Data

Mar. 18, 1976 [GB] United Kingdom ..... 11008/76
Jul. 22, 1976 [GB] United Kingdom ..... 30490/76

[51] Int. Cl.[2] ..... E01F 9/01

[52] U.S. Cl. ..... 248/218.4; 248/73; 248/225.1; 248/231; 403/398; 403/400

[58] Field of Search ..... 248/218.4, 219.3, 219.4, 248/223.4, 224.1, 224.2, 225.1, 231, 228, 72, 73, 74 R, 74 B, 74 PB; 24/201 A, 284; 403/356, 398, 399, 400; 52/38; 105/469, 473, 482, 485

[56] References Cited

U.S. PATENT DOCUMENTS

| | | | |
|---|---|---|---|
| 2,375,513 | 5/1945 | Bach | 248/72 X |
| 3,226,069 | 12/1965 | Clarke | 248/73 |
| 3,313,424 | 4/1967 | Gingher | 16/87.2 X |
| 3,330,517 | 7/1967 | Zimmermann | 248/74 R |
| 3,347,505 | 10/1967 | Menser | 248/218.4 X |
| 3,539,138 | 11/1970 | Desroches | 248/231 X |
| 3,854,684 | 12/1974 | Moore | 248/73 X |
| 3,894,707 | 7/1975 | Heard | 248/231 |

FOREIGN PATENT DOCUMENTS

| | | | |
|---|---|---|---|
| 1,217,710 | 5/1966 | Fed. Rep. of Germany | 248/223.4 |
| 1,264,894 | 3/1968 | Fed. Rep. of Germany | 248/74 R |
| 1,524,213 | 5/1968 | France | 248/74 R |
| 2,119,271 | 8/1972 | France | 403/400 |
| 56,873 | 9/1944 | Netherlands | 248/73 |
| 933,929 | 8/1963 | United Kingdom | 248/74 PB |

*Primary Examiner*—Rodney H. Bonck
*Attorney, Agent, or Firm*—Larson, Taylor and Hinds

[57] ABSTRACT

A device for mounting a sign to a post, wherein the back of the sign carries a channel member with a restricted mouth. A strap is connected to the channel by a pair of attachment members and tightened around the post. At least one attachment member is made of sheet metal and comprises a neck to go through the channel mouth, the end of the neck carrying a larger plate at right angles thereto to be retained within the restricted mouth. The plate extends lengthwise of the channel on each side of the neck, and preferably the neck extends through a slot in the plate and is secured to the remote side thereof.

18 Claims, 5 Drawing Figures

SECURING DEVICE

FIELD OF THE INVENTION

This invention relates to devices for securing two bodies together, and more particularly by tightening around one body a strap which is attached to a channel member carried by the other body and having a restricted mouth.

BACKGROUND OF THE INVENTION

In my co-pending U.S. patent application Ser. No. 695,411, now U.S. Pat. No. 4,094,487 there is disclosed a device for securing to a post a body provided with a channel member having a restricted mouth, the device comprising an elongate plate for insertion lengthwise into the channel to extend across its mouth and be retained in the channel by the inturned lips thereof, a pair of attachment members connected or arranged for connection to the elongate member through the mouth of the channel and connected or arranged for connection to a strap to be passed around the post. This device, while being very strong, extremely difficult to force out of the channel, and easy to use on site, has certain disadvantages. The spacing of the attachment members is fixed, so it is necessary to have different sizes of device for different size posts unless an intermediate saddle is used. The full length insert plate represents a substantial part of the materials cost, and the device requires at least two welds which add to the labour and time costs in manufacture. Also, it is sometimes inconvenient on site to have a unitary construction of that type for insertion into the channel as a single unit. The present invention seeks to ameliorate some or all (depending on the particular embodiments) of the above disadvantages.

SUMMARY OF THE INVENTION

The present invention discloses a modification in which, instead of a single elongate member carrying both attachment members, one or both attachment members are made of rigid sheet material and include separate attachment means comprising a plate part for insertion lengthwise into the channel member to extend across its mouth and be retained therein by the lips of the channel member, and a neck part extending from the plate part through the channel mouth.

This arrangement provides the versatility of separate attachment members which can be inserted from opposite ends of the channel and whose relative positions in the channel member can be optionally located for different sizes of body around which the strap is tightened. The separate relatively short plate parts use less material and yet surprisingly provide sufficient bearing area under the channel lips to give little risk of distortion of the channel. Although the neck part and plate part are both made of sheet material, e.g. stainless steel sheet, so that in theory the union between the parts could bend under the tension of the strap and reduce the bearing area of the plate and channel lips, in practice it has been surprisingly found that this union is very resistant to bending, particularly if the plate extends longitudinally of the channel on each side of the neck part. The separate attachment members seem to be self-aligning in the channels, thereby minimising distortional forces. Securing devices of this kind made of stainless steel sheet in soft aluminium channels have been found to withstand high loads and strains, for example in mounting heavy road signs in windy regions.

BRIEF DESCRIPTION OF THE DRAWINGS

Various embodiments will be described with reference to the accompanying drawings, wherein.

DESCRIPTION OF PREFERRED EMBODIMENTS

Figure 1:
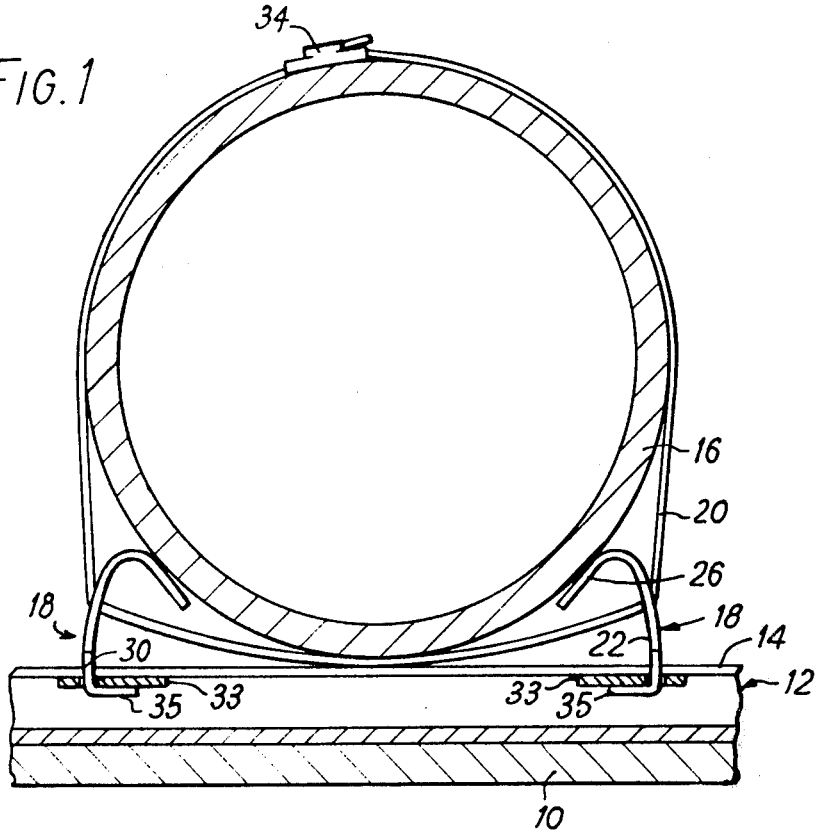
FIG. 1 shows a cross-sectional view through a post supporting a sign using one embodiment of securing device.
Figure 2:
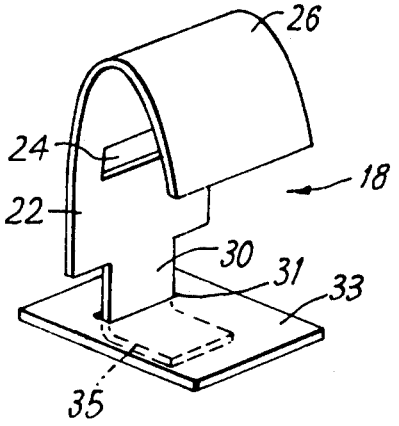
FIG. 2 shows a perspective view of one of the attachment members of FIG. 1.

Referring to FIGS. 1 and 2 of the drawings; a sign panel 10 is provided on its rear surface with a channel member 12, made for example of extruded aluminium, and having a rearwardly directed mouth restricted by a pair of inturned lips 14. The sign is mounted to a circular section post 16 by means of a pair of attachment members 18 and a flexible strap 20 of high tensile material, such as stainless steel. The attachment members 18 are also conveniently made of stainless steel sheet. Each attachment member comprises a body part 22 having a slot 24 to receive the strap 20. One end of the body is bent over at 26 to seat against the post 16. From the other end of the body extends a narrower neck 30 which passes through a slot 31 in a rectangular plate 33 and is turned over at right angles at 35 to be welded to the surface of the plate 33 remote from the body part 22. It is preferred that the end of the neck be turned over in the same direction as the end of the body part, but it could be turned over in the opposite direction.

In mounting the sign to the post, each attachment member is attached to the channel by inserting the plate into the end of the channel and sliding it lengthwise of the channel until it is in the desired position, the neck 30 extending through the restricted mouth of the channel, and the two turned-over portions 26 being directed towards each other. The strap 20 is then passed through slots 24, the sign is offered up to the post so that the post seats between the turned-over ends 26 of the attachment members, and the ends of the strap are tightened around the post and secured together by a buckle 34 in known manner.

The particular configuration of the attachment members removes any tendency for them to slide towards each other under the tension of the strap, and thereby relax the tension. The strap, passing through the apertures 24, pulls the attachment members firmly up against the lips of the channel approximately tangentially to the post and at right-angles to the mouth of the channel. If desired, the strap can be threaded through the attachment members prior to their fitting in the channel.

Although only one channel member and securing device and one post are shown, the sign will usually have more than one channel member, sometimes more than one post, and a corresponding number of securing devices, depending on the size of the sign.

Figure 3:
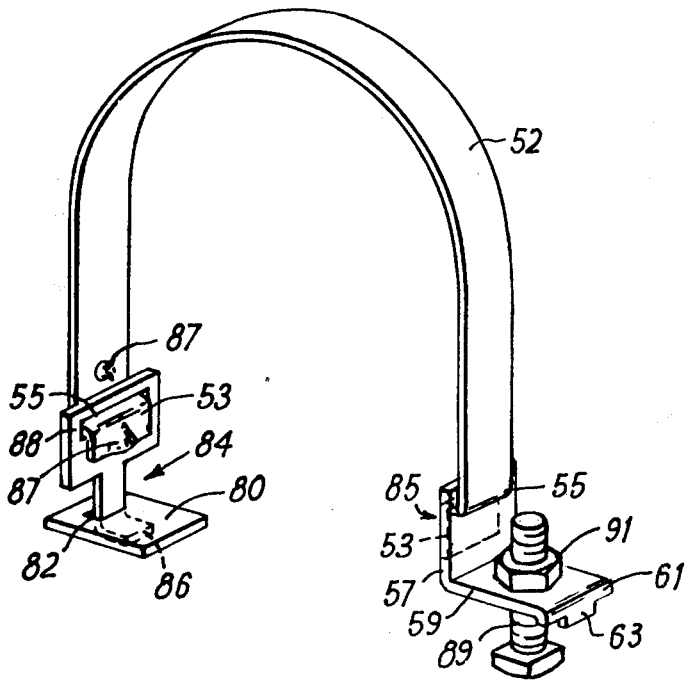
FIG. 3 shows a perspective view of another embodiment of device for securing a sign to a post.

Referring to FIG. 3; the device comprises a strap 52 of U-shaped form, suitably made of stainless steel strip, to be passed around the post. The ends of the strap are cranked at 53 for engagement in slots 55 in the bodies of attachment members 84, 85 respectively. The attachment members are also made of stainless steel sheet. The attachment member 84 is a generally T-shaped form, with a body 88 and a narrower neck 86. The neck 86 passes through a slot 82 in a short rectangular plate 80, and the end of the neck is turned at right-angles to the rest of the attachment member and towards the opposite attachment member 85, and is spot-welded to the underside of the plate 80.

The attachment member 85 is a generally L-shaped form, one limb 57 having the slot 55, and the other limb 59 being apertured to take the shank of a bolt 89, which is retained by a nut 91. The end of the limb 59 is downturned to provide a rib 61, which is further extended to provide a central lug 63. The attachment member 85 and its manner of use are more particularly described in my British Patent Specification No. 1416734. If desired, the cranked end 53 of the strap is spot-welded to the attachment member 85. The other end of the strap, however, is a loose fit in the slot 55 of the attachment member 84, and is retained therein by blips 87 formed in the cranked end of the strap. Thus, the attachment member 84 is, in effect, hingedly connected to the strap 52.

In use; a number of attachment members of the present invention are fitted to the channel members on the rear of the sign, as described above in relation to FIG. 1. This is effected by introducing the head of the bolt 89 and the plate 80 into the end of the channel, and sliding them along the channel to the desired position for securing to the post. At some stage the attachment member 85 has to be detached from the bolt 89. This can be done before introducing the bolt into the channel, or thereafter just prior to mounting the sign to the post. With the attachment member 85 detached from the bolt, the strap 52 can be hinged relative to the attachment member 84, and when the sign is offered up to the post the strap 52 can be passed around the post and the attachment member 85 once more reattached to the bolt 89 by means of the nut 91. The nut 91 is then tightened to draw the strap tightly around the post. The downturned rib 61 on the attachment member 85 bears upon the lips of the channel member, and the lug 63 engages in the mouth of the channel.

Various modifications are possible within the scope of the present invention. For example, the L-shaped attachment member 85 could be formed as an integral extension of the strap 52. Alternatively, the attachment member 85 could be replaced by a second attachment member 84. In such a case, to provide for the necessary adjustment of the strap, the strap could conveniently be formed in two parts extending from respective attachment members, the ends of the strap parts being drawn around the post and secured together in known manner, for example by a "Band-it" or "Tespa" buckle. The T-shaped part of the attachment member 84 could, particularly in the modification last described, be formed as an integral extension of the strap, rather than as a separate member.

Figure 4:
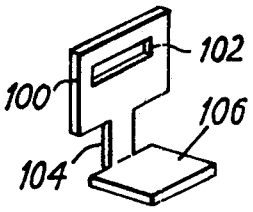
FIGS. 4 and 5 show perspective views of further embodiments of attachment members.
Figure 5:
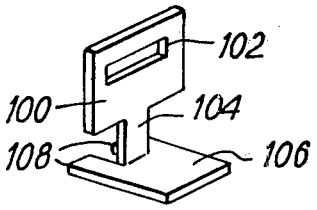

FIGS. 4 and 5 show modified attachment members made from a single piece of sheet steel. In FIG. 4, a rectangular body part 100 has a slot 102 to receive a strap as in the previous embodiments, and carries a narrower neck part 104 to extend through the mouth of the channel member. The far end of the neck carries an enlarged plate part 106 integrally formed therewith and simply bent at right angles to the plane of the neck part. FIG. 5 shows a similar construction except that the portions of the sheet material on either side of the neck which would be cut out in the embodiment of FIG. 4, are left attached to the plate part 106, thereby providing extensions 108 on the other side of the neck part. This may further improve the strength and stability of the device as compared with that of FIG. 4. Instead of a slotted body part to take a separate strap, the body part in the attachment members of FIGS. 4 and 5 could be integral with respective straps which are tightened around the post and secured together at their ends remote from the attachment members.

The plate parts of the present securing devices are preferably somewhat longer than they are wide. This gives increased bearing area under the lips and prevents their being inadvertently inserted into the channel at right-angles to the correct orientation. Also, as shown in all the illustrated embodiments, the junction between the neck part and the plate part, that is, the bend between the two in the case of FIGS. 4 and 5, or the location of the slot in the plate in the case of FIGS. 2 and 3, is offset from the center of the plate part along the direction of the channel mouth such that at least a major portion of the plate part lies to one side of the junction with the neck part.

I claim:

1. An assembly comprising first and second bodies and a device securing them together, the first body having a channel member with a mouth restricted by inturned lips; the securing device comprising a pair of separate attachment members having means for attachment to said channel member by extending through the mouth and being retained therein by the inturned lips, the attachment members being attached to the channel on either side of said second body, and strap means associated with the attachment members tightened around the second body so as to clamp it to the channel, at least one of the attachment members being made of rigid sheet material and having non-adjustable attachment means comprising a neck part extending through the channel mouth, and a plate part rigidly carried by the inner end of the neck part in a plane substantially at right angles to the part of the neck part which extends through the channel mouth such that one major face of the plate part faces and bears against the channel lips, the junction between said neck part and said plate part being offset from the center of the plate part along the direction of the channel mouth such that at least a major portion of the plate part lies to one side of the junction with the neck part, the plate part being wider than the neck part so as to be retained by the channel lips engaging one major face of the plate part.

2. An assembly according to claim 1 wherein one attachment member has said non-adjustable attachment means and the other comprises an apertured body part, its said attachment means comprising a screw-threaded bolt passing through the aperture and extending through the channel mouth and having an enlarged head retained by the channel lips, and a nut co-operating with the bolt to adjustably secure the bolt to the body part of the attachment member whereby the strap means is tightened around said second body.

3. An assembly according to claim 2 wherein the strap means comprises a single strap connected at its opposite ends to respective attachment members.

4. An assembly according to claim 2 wherein the strap means comprises a single strap connected at its opposite ends to respective attachment members by cranks formed at its ends which engage in slots in the attachment members.

5. An assembly according to claim 1 wherein both attachment members have said non-adjustable attachment means, said strap means comprising a single strap passed through apertures in the attachment members, the ends of the strap being interconnected and tightened around said second body.

6. An assembly according to claim 5 wherein each said attachment member has a body part carrying said neck part and slotted to receive the strap, the end portions of the two body parts on the side of their slots remote from their neck parts being turned over towards each other to provide a seating for the surface of said second body.

7. An assembly according to claim 1 wherein the neck part extends through an aperture in the plate part and is secured to the remote surface of the plate part.

8. An assembly according to claim 1 wherein said plate part has a length in the dimension at right angles to the plane of the neck part greater than its width in the dimension parallel to said plane.

9. An assembly according to claim 1 wherein the plate part extends on each side of the plane of the neck part.

10. An assembly according to claim 1 wherein the plate part is integrally formed with said neck part and is bent through substantially a right angle out of the plane of the neck part along the direction of the channel mouth, the plane of said neck part being transverse to the direction of the channel mouth.

11. An assembly according to claim 10 wherein the plate part extends on each side of the plane of the neck part.

12. An attachment member for linking a strap with a channel member, the mouth of the channel being restricted by inturned lips; the attachment member being made of rigid sheet material and comprising a body part adapted for connection to a strap, a neck part projecting from the body part for extending through the channel mouth, and a plate part rigidly carried by the neck part in a plane substantially at right angles thereto, the plate part being wider than the neck part so as to be retained by the channel lips engaging one face of the plate part, the body part being slotted to receive a strap, the end portion of the body part on the side of the slot remote from the neck part being turned over to make an acute angle with the rest of the body part.

13. An attachment member according to claim 12 wherein the neck part extends through an aperture in the plate part and is secured to the remote surface of the plate part.

14. An attachment member according to claim 12 wherein the plate part has a length in the dimension at right angles to the plane of the neck part greater than its width in the dimension parallel to said plane.

15. An attachment member according to claim 12 wherein the plate part extends on each side of the plane of the neck part.

16. A device for securing two bodies together by tightening around one body a strap which is attached to a channel member carried by the other body, the mouth of the channel being restricted by inturned lips; the device comprising a pair of separate attachment members having means for attachment to such a said channel member by extending through the mouth and being retained therein by the inturned lips, and strap means associated with the attachment members for tightening around the one body, both of said attachment members being made of rigid sheet material and having non-adjustable attachment means comprising a neck part for extending through the channel mouth and a plate part rigidly carried by the neck part in a plane substantially at right angles thereto, the plate part being wider than the neck part so as to be retained by the channel lips engaging one face of the plate part, each said attachment member having a body part carrying said neck part and slotted to receive the strap means, said strap means comprising a single strap passed through said slots, the ends of the strap being interconnectable and tightenable around said one body, the end portions of said two body parts on the side of their slots remote from their neck parts being turned over toward each other to provide a seating for the surface of said one body.

17. An assembly comprising first and second bodies and a device securing them together, the first body having a channel member with a mouth restricted by inturned lips; the securing device comprising a pair of separate attachment members having means for attachment to said channel member by extending through the mouth and being retained therein by the inturned lips, the attachment members being attached to the channel on either side of said second body, and strap means associated with the attachment members tightened around the second body so as to clamp it to the channel, at least one of the attachment members being made of substantially rigid sheet material and having non-adjustable attachment means comprising a neck part extending through the channel mouth, and a plate part rigidly carried by the inner end of the neck part in a plane substantially at right angles to the neck part such that one major face of the plate part faces and bears against the channel lips, said neck part and said plate part being integrally formed from a single piece of said sheet material, the plate part being bent through substantially a right angle out of the plane of said neck part along the direction of the channel mouth, the plane of said neck part being transverse to the direction of the channel mouth, the plate part being wider than the neck part so as to be retained by the channel lip engaging one major face of the plate part.

18. An assembly according to claim 17 wherein the plate part extends on each side of the plane of the neck part.

* * * * *